United States Patent [19]

Brennan et al.

[11] 4,157,648

[45] Jun. 12, 1979

[54] COMPOSITION AND METHOD FOR INFLATION OF PASSIVE RESTRAINT SYSTEMS

[75] Inventors: Richard L. Brennan; George A. Lane, both of Midland, Mich.

[73] Assignee: The Dow Chemical Company, Midland, Mich.

[21] Appl. No.: 586,457

[22] Filed: Jun. 12, 1975

Related U.S. Application Data

[63] Continuation of Ser. No. 358,188, May 7, 1973, abandoned, which is a continuation-in-part of Ser. No. 199,808, Nov. 17, 1971, abandoned.

[51] Int. Cl.[2] ..... C06D 5/06

[52] U.S. Cl. ..... 60/205; 149/35; 423/351

[58] Field of Search ..... 149/19.3, 35; 280/150 AB; 23/281; 60/205

[56] References Cited

U.S. PATENT DOCUMENTS

| | | | |
|---|---|---|---|
| 3,741,585 | 6/1973 | Hendrickson et al. | 280/150 AB |
| 3,785,674 | 1/1974 | Poole et al. | 23/281 X |
| 3,865,660 | 2/1975 | Lundstrom | 149/35 |

*Primary Examiner*—Edward A. Miller

*Attorney, Agent, or Firm*—Bruce M. Kanuch; G. H. Korfhage

[57] ABSTRACT

Disclosed is a composition and method for the inflation of passive restraint systems, i.e., crash bags. The method, which uses the gases produced by the ignition of certain alkali metal azides in combination with certain metal halides for inflation of the bag, provides a non-toxic gas for inflation. Use of sufficient metal halide to provide halogen in an amount at least stoichiometric with the alkali metal prevents the formation of free alkali metal, the latter considered to be toxic and to present an unsuitable material in passive restraint systems.

11 Claims, No Drawings

COMPOSITION AND METHOD FOR INFLATION OF PASSIVE RESTRAINT SYSTEMS

CROSS-REFERENCE TO RELATED APPLICATION

This is a continuation of application Ser. No. 358,188 filed May 7, 1973, and abandoned after filing this application, which was in turn a continuation-in-part of Ser. No. 199,808, filed Nov. 17, 1971, now abandoned.

BACKGROUND OF THE INVENTION

In recent years, emphasis has been placed upon the development of systems for holding automobile passengers in their seats during the sudden deceleration experienced as a result of a collision. Seat belts and shoulder harnesses have been shown to be effective to decrease both the frequency and severity of injuries resulting from automobile accidents. However, these devices suffer from one major drawback; they must be buckled by the passenger. The widespread failure on the part of the motoring public to "buckle up" has led to a demand for devices which will hold the passenger in his seat without the need for any overt act. Such a "passive restraint" system would be built into the automobile and be automatically activated upon collision by a sensing device.

One promising passive restraint system is the inflatable gas cushion or crash bag. In this system, a flow of gas is employed to rapidly fill a flexible bag upon activation of the system. The inflated bag provides cushioning during the rapid deceleration, thus preventing contact of the occupant with the car interior and reducing the chance of serious injury during an accident. After initial contact, the bag slowly deflates to avoid entrapment of the passenger. During this process, gases employed to inflate the bag also escape into the atmosphere surrounding an occupant. Thus, the gases must not in themselves be detrimental to human health since the benefits of the restraint system are then lost.

One type of crash bag system employs high pressure nitrogen stored in a gas bottle to fill the bag. Activation of the unit releases the nitrogen which flows into the bag. Such a stored gas system is undesirable from the standpoint of cost and poor adaptability to automotive styling caused by its size and weight.

An alternative to the compressed gas system lies in the use of a pyrotechnic generator. In this system, a small pyrotechnic charge is set off upon activation and upon burning evolves sufficient gas to fill the bag. This type of system offers a cost advantage as well as adaptability to a relatively compact, lightweight generating device, such as that disclosed in a co-pending application entitled "Gas Generator" filed in the U.S. Patent Office by Gerald R. Staudacher, Thomas E. Dergazarian, and George A. Lane on July 31, 1972, as application Ser. No. 276,397 which was a continuation-in-part of application Ser. No. 168,234, filed Aug. 2, 1971.

In order to be useful in such a system, the pyrotechnic composition must meet several criteria. The first of these is that it release sufficient gas to fill a bag of suitable volume to a pressure of at least 1 psig within 20–60 milliseconds of ignition. The second is that the gases released should not present a toxicity problem to the automobile occupants. Furthermore, the gas produced should not increase the temperature of the bag to the point of causing serious thermal injury or pain. Additionally, the noise level upon functioning should remain below 170 DB and preferably below 150 DB. A further requirement is that such a composition remain operable between −20° and 220° F. ambient temperature.

It is an object of the present invention to provide a method for inflating a crash bag type passive restraint system which meets or exceeds the above criteria.

SUMMARY OF THE INVENTION

The present invention is a composition and method for inflation of the aforementioned crash bag. The composition comprises a mixture of an alkali metal azide of the formula $AN_3$ where A is lithium, sodium, potassium, cesium or rubidium and a metal halide of the formula $MX_n$ where M is tin, titanium, zinc, strontium, barium, cobalt, nickel, manganese, molybdenum or magnesium, X is chlorine, bromine or iodine and n is an integer representing the valence state of M. Although fluorides can be used to provide a gas generating composition, fluorides are well-known to be hazardous to human health and therefore should be avoided in the practice of the present invention. Sufficient metal halide is employed to provide halogen in amount at least stoichiometric with the alkali metal.

DETAILED DESCRIPTION

It is reported by Egghart in *Inorganic Chemistry,* Vol. 4, No. 8 at pages 1195–1200 that the decomposition of molten potassium azide to potassium and nitrogen can be accelerated by the addition of small amounts of a metal halide to the azide, e.g., 2.2 mole percent of $CoCl_2$. The reference reports the production of gaseous nitrogen and molten potassium. Such a system produces nitrogen in sufficient purity to be non-toxic; however, the coproduction of elemental potassium is unacceptable in a crash bag system due to its toxic nature. The present system is predicated on the discovery that the ignition of an alkali metal azide in combination with certain metallic halides rapidly procedures free nitrogen without coproduction of the free alkali metal. The reaction proceeds according to the equation:

$$nAN_3 + MX_n \rightarrow nAX + M + (3n/2)N_2$$

where A is an alkali metal, M is a second metal, X is a halogen and n is an integer representing the valence state of M. This formula indicates why it is desirable to provide at least a stoichiometric quantity of halide based on the production of AX so that free elemental A is not produced. Since on storage it is possible for the following metathesis reaction to occur with certain mixtures:

$$nAN_3 + MX_n \rightarrow nAX + M(N_3)_n$$

M should be selected so that $M(N_3)_m$ is relatively free of sensitivity. For example, silver, copper, lead and mercury chloride are unacceptable in the present system due to the sensitivity of the corresponding azides. It has been discovered that aluminum and iron are unsuitable because a mixture of the dry powders undergo hazardous reactions. Certain other metal halides can be eliminated from consideration for the reason that they do not react with the alkali metal azide quickly enough to meet the time requirements for filling the crash bag.

It has been determined that the tin, titanium, zinc, strontium, barium, cobalt, nickel, manganese, molybdenum or magnesium cations with chlorine, bromine or iodine as the halogen can be used effectively in the instant invention. Of the alkali metals, lithium, sodium and potassium are preferred. The preferred metal halides are $SnCl_2$, $ZnBr_2$, $ZnCl_2$, $MgCl_2$ and $TiCl_3$. Generally, a slight excess of the metal halide, up to 10 percent above stoichiometric, is employed. Mixtures of two or more of the alkali metal azides or metal halides disclosed here are deemed to be encompassed by the present invention.

The invention is further illustrated by the following examples.

EXAMPLE 1

A nitrogen generating composition was prepared as follows:

Finely ground anhydrous stannous chloride, 34.35 grams, was mixed by tumbling with 22.90 grams of finely ground, dry sodium azide. A 57.25 gram pellet was made of this composition by pressing at 12,425 psi in a two inch die. The pellet was loaded into a gas generator of the type described in the above mentioned co-pending application. Three metal screens surrounded the pellets inside the generator. The generator was then fitted with a 1.4 cubic foot neoprene coated nylon gas bag. Both the generator and the bag were fitted with pressure transducers. Ignition of the pellets was accomplished with an 8 grain duPont squib. Combustion of the composition produced a peak generator pressure of 1,000 psi and a steady state bag pressure of nearly 3.9 psig. The peak pressure in the generator was reached in 6.4 milliseconds from the time of signal to the squib. Peak bag pressure was obtained in 8 milliseconds. The bag was completely filled with gas in less than 30 milliseconds.

The solid material remaining in the generator was tested for the presence of free sodium by the addition of water. No reaction was observed, indicating the absence of free sodium.

EXAMPLE 2

In order to determine what other metallic azides and halides are useful in the present invention, the following experiments were run. Stoichiometric mixtures of various metal halides (anhydrous) and metal azides were prepared by tumbling the loose powders until thoroughly mixed and burned at atmospheric pressure. All reactants were finely ground before mixing. After the burning the ash was examined for free alkali metal by the addition of water.

In a second series of tests a metal azide was mixed with certain organic chloro compounds. Tests with fluoro compounds were not conducted because of the knowledge that certain fluoride compounds are generally toxic, for example, NaF is a known pesticide. Organic bromo and iodine compounds were also not tested since during the combustion of the composition elemental $Br_2$ or $I_2$ may be formed.

TABLE I

BURNING TESTS OF VARIOUS METAL HALIDES AND AZIDES

| Run No. | Halide Salt | Amount (Grams) | Azide Salt | Amount (Grams) | Comments |
|---|---|---|---|---|---|
| 1 | $SnCl_2$ | 1.2 | $NaN_3$ | 0.8 | Good burn; no Na metal in ash. |
| 2 | $AlCl_3$ | 0.68 | $NaN_3$ | 1.0 | Slower burn than No. 1, no Na metal in ash. However, in other tests evolution of heat and partial melting occurred indicating instability. Also, in other instances, the mixture exploded even prior to ignition. |
| 3 | $FeCl_3$ | 0.83 | $NaN_3$ | 1.0 | Fast burn; no Na metal in ash. However, upon mixing an immediate color change occurred indicating a chemical change. The resulting mixture was found to be sensitive to mechanical impact. |
| 4 | $SrCl_2$ | 1.22 | $NaN_3$ | 1.0 | Slow burn, sputtered; no sodium noted in ash. |
| 5 | $CoCl_3$ | 1.0 | $NaN_3$ | 1.0 | Good rapid burn; no sodium noted. |
| 6 | $MgCl_2$ | 0.73 | $NaN_3$ | 1.0 | Sputtering but reaction could not be maintained at ambient atmospheric pressure. Visual observation indicates that the composition would be suitable for reacting under an elevated pressure. Fast burn, no sodium. |
| 7 | $ZnCl_2$ | 1.05 | $NaN_3$ | 1.0 | Fast burn, no sodium |
| 8 | $ZnBr_2$ | 1.73 | $NaN_3$ | 1.0 | Good burn, similar to that obtained with $ZnCl_2$, no sodium metal. |
| 9 | $SnCl_2$ | 1.0 | $KN_3$ | 0.85 | Sparky burn, K° thrown from reaction, slow burning rate. Would be useful for use under elevated pressures. |
| 10 | $SnCl_2$ | 1.0 | $LiN_3$ | 0.515 | Extremely fast burn, no active metal in ash. |
| 11 | $SnCl_2$ | 1.0 | $CsN_3$ | 1.84 | Fast burn, more rapid than $NaN_3$ but slower than $LiN_3$, no active metal in ash. |
| 12 | $SnCl_2$ | 1.0 | $RbN_3$ | 0.85 | Fast burn, similar to $NaN_3$, no active metal in ash. |

TABLE I-continued

BURNING TESTS OF VARIOUS METAL HALIDES AND AZIDES

| Run No. | Halide Salt | Amount (Grams) | Azide Salt | Amount (Grams) | Comments |
|---|---|---|---|---|---|
| 13 | $FeCl_3$ | 0.80 | $KN_3$ | 1.2 | $KN_3$ was ground to -100 mesh on U.S. Standard Sieve series. No sputtering was observed; no active metal in ash. However, upon mixing an immediate color change occurred indicating a chemical change. The resulting mixture was found to be sensitive to mechanical impact. |
| 14 | $SnCl_2$ | 1.9 | $KN_3$ | 1.8 | Both $KN_3$ and $SnCl_2$ ground to -100 mesh. Rapid burn, no sputtering; no active metal in ash. |
| 15 | Hexachlorocyclopentadiene dimer | 4.2 | $NaN_3$ | 5.8 | Good ignition and burn. However large quantities of metallic sodium produced and loss of some organic compound occurred because of heat of burning. |
| 16 | Hexachlorobutadiene | 4.1 | $NaN_3$ | 5.9 | " |
| 17 | Hexachloroethane | 3.8 | $NaN_3$ | 5.7 | Poor ignition. Uneven, unsteady burn. Large quantities of sodium produced. |
| 18 | Hexachlorobenzene | 4.3 | $NaN_3$ | 5.7 | Poor ignition. Uneven, unsteady burn. Large quantities of sodium produced. |

We claim:

1. A method of rapidly generating nitrogen which comprises: igniting an intimate mixture of a metal azide of the formula $AN_3$ where A is lithium, sodium, potassium, rubidium, or cesium; and a metal halide selected from the group consisting of $SnCl_2$, $ZnBr_2$, $ZnCl_2$, and $TiCl_3$; said method being further defined in that the amount of metal halide employed is an amount sufficient to provide halogen in at least a stoichiometric ratio with the alkali metal so that the combustion products are substantially free of elemental alkali metal.

2. The method of claim 1 wherein the mixture of metal azide and metal halide is ignited in close proximity to and in fluid communication with a flexible container, thereby filling the container with combustion gases on ignition of the mixture.

3. A composition which burns to produce gases which are rich in nitrogen and substantially free of elemental alkali products, said composition being substantially free of elemental metals, which comprises: an intimate mixture of a metal azide of the formula $AN_3$ where A is lithium, sodium, potassium, rubidium, or cesium; and a metal halide selected from the group consisting of $SnCl_2$, $ZnBr_2$, $ZnCl_2$, and $TiCl_3$; said composition being further defined in that the metal halide is present in an amount sufficient to provide halogen in at least a stoichiometric ratio with the alkali metals so that combustion products produced upon burning are substantially free of elemental alkali metal.

4. The method of claim 2 wherein A is sodium and the metal halide is $SnCl_2$.

5. The method of claim 2 wherein A is sodium and the metal halide is $ZnCl_2$.

6. The method of claim 2 wherein A is sodium and the metal halide is $ZnBr_2$.

7. The method of claim 2 wherein A is lithium and the metal halide is $SnCl_2$.

8. The composition of claim 3 wherein A is sodium and the metal halide is $SnCl_2$.

9. The composition of claim 3 wherein A is sodium and the metal halide is $ZnCl_2$.

10. The composition of claim 3 wherein A is sodium and the metal halide is $ZnBr_2$.

11. The composition of claim 3 wherein A is lithium and the metal halide is $SnCl_2$.

* * * * *